US007563517B2

(12) United States Patent
Raffy et al.

(10) Patent No.: US 7,563,517 B2
(45) Date of Patent: Jul. 21, 2009

(54) METAL COATING FOR A KITCHEN UTENSIL

(75) Inventors: Stéphane Raffy, Cavaillon (FR); Jean-Marie Dubois, Pompey (FR); Valérie Demange, Nancy (FR); Marie-Cécile De Weerd, Villiers les Nancy (FR)

(73) Assignees: Saint Gobain Centre de Recherches et d-Etudes European "Les Miroirs", Courbevoie (FR); Centre National de la Recherche Scientifique, Paris (FR)

( * ) Notice: Subject to any disclaimer, the term of this patent is extended or adjusted under 35 U.S.C. 154(b) by 10 days.

(21) Appl. No.: 10/589,576

(22) PCT Filed: Feb. 9, 2005

(86) PCT No.: PCT/FR2005/000290

§ 371 (c)(1),
(2), (4) Date: Jun. 22, 2007

(87) PCT Pub. No.: WO2005/083139

PCT Pub. Date: Sep. 9, 2005

(65) Prior Publication Data

US 2008/0032151 A1 Feb. 7, 2008

(30) Foreign Application Priority Data

Feb. 16, 2004 (FR) ..... 04 01536

(51) Int. Cl.
*B32B 5/16* (2006.01)
*B32B 15/20* (2006.01)

(52) U.S. Cl. ..... 428/650; 428/615

(58) Field of Classification Search ..... None
See application file for complete search history.

(56) References Cited

U.S. PATENT DOCUMENTS

| | | | | |
|---|---|---|---|---|
| 5,571,344 | A | 11/1996 | Dubois et al. | |
| 5,827,573 | A * | 10/1998 | Tsai | 427/327 |
| 6,017,403 | A * | 1/2000 | Masumoto et al. | 148/549 |
| 6,254,699 | B1 * | 7/2001 | Hermanek | 148/403 |
| 6,533,285 | B2 * | 3/2003 | Nava et al. | 277/415 |
| 6,749,951 | B1 * | 6/2004 | Darolia et al. | 428/615 |
| 2004/0256236 | A1 * | 12/2004 | Minevski et al. | 205/109 |

FOREIGN PATENT DOCUMENTS

| | | |
|---|---|---|
| EP | 0 356 287 | 2/1990 |
| EP | 0 675 209 | 10/1995 |
| EP | 0 821 072 | 1/1998 |
| FR | 2 671 808 | 7/1992 |
| FR | 2 744 839 | 8/1997 |
| JP | 10-265918 | * 10/1998 |

OTHER PUBLICATIONS

JP 10-265918 English Abstract, Kubo et al, Oct. 1998.*
JP 10-265918 English Machine Translation. Kubo et al, Oct. 1998.*
A Sadoc and J. M. Dubois; "Structural Relationships Between Non-Crystalline Phases in AlMn and AlFeCr Systems Through Exafs Measurements", Journal of Physics, Condensed Matter, Bristol, GB, vol. 1, No. 27, Jul. 1989, pp. 4283-4296.
International Search Report mailed Jun. 24, 2005.

* cited by examiner

*Primary Examiner*—Jennifer McNeil
*Assistant Examiner*—Jason L Savage
(74) *Attorney, Agent, or Firm*—Crowell & Moring

(57) ABSTRACT

The invention relates to a metal coating for a utensil for cooking food products.

The coating consists of an aluminum-based alloy containing more than 80% by weight of one or more quasicrystalline or approximant phases, having the composition $Al_a(Fe_{1-x}X_x)_b(Cr_{1-y}Y_y)_cZ_zJ_j$ in which: X represents one or more elements isoelectronic with Fe, chosen from Ru and Os; Y represents one or more elements isoelectronic with Cr, chosen from Mo and W; Z is an element or a mixture of elements chosen from Ti, Zr, Hf, V, Nb, Ta, Mn, Re, Rh, Ni and Pd; J represents the inevitable impurities other than copper; $a+b+c+z=100$; $5 \leqq b \leqq 15$; $10 \leqq c \leqq 29$; $0 \leqq z \leqq 10$; $xb \leqq 2$; $yc \leqq 2$; and $j<1$.

2 Claims, No Drawings

METAL COATING FOR A KITCHEN UTENSIL

The present invention relates to a metal coating for a cooking utensil.

BACKGROUND OF THE INVENTION

Various metals or metal alloys, for example aluminum alloys, are known for their good mechanical properties, their good thermal conductivity, their lightness and their low cost, and they have for a long time found many applications, especially for cooking utensils and vessels. However, most of these metals or metal alloys have drawbacks associated with their insufficient hardness and their insufficient wear resistance, or with their low corrosion resistance.

Attempts to obtain alloys with improved properties have been made, and these have ended in particular in quasicrystalline alloys. For example, FR-2 744 839 describes quasicrystalline alloys having the atomic composition $Al_aX_dY_eI_g$ in which X represents at least one element chosen from B, C, P, S, Ge and Si, Y represents at least one element chosen from V, Mo, Cr, Mn, Fe, Co, Ni, Ru, Rh and Pd, I represents the inevitable smelting impurities, $0 \leqq g \leqq 2$, $0 \leqq d \leqq 5$, $18 \leqq e \leqq 29$ and a+d+e+g=100%. The use of an alloy having the composition $Al_{71}Cu_9Fe_{10}Cr10$ as internal coating of a Pyrex® glass cooking vessel has also been described. FR-2 671 808 describes quasicrystalline alloys having the atomic composition $Al_aCu_bCo_b$, $(B,C)_cM_dN_eI_f$, in which M represents one or more elements chosen from Fe, Cr, Mn, Ru, Mo, Ni, Ru, Os, V, Mg, Zn and Pd, N represents one or more elements chosen from W, Ti, Zr, Hf, Rh, Nb, Ta, Y, Si, Ge and rare earths, and I represents the inevitable smelting impurities, with $a \geqq 50$, $0 \leqq b \leqq 14$, $0 \leqq b' \leqq 22$, $0 < b+b' \leqq 30$, $0 \leqq c \leqq 5$, $8 \leqq d \leqq 30$, $0 \leqq e \leqq 4$, $f \leqq 2$ and a+b+b'+c+d+e+f=100%. The alloys having the composition $Al_aCu_bCo_b$, $(B,C)_cM_dN_eI_f$, with $0 \leqq b \leqq 5$, $0 < b' < 22$, $0 < c < 5$, and M represents Mn+Fe+Cr or Fe+Cr, are recommended as coating for cooking utensils. According to Z. Minevski et al., [Symposium MRS, Fall 2003, "Electrocodeposited Quasi-crystalline Coatings for Non-stick, Wear Resistant Cookware"], the quasicrystalline alloys have good mechanical properties and surface characteristics that make them particularly useful for various applications, especially for the coating of cooking utensils. The alloy $Al_{65}Cu_{23}Fe_{12}$ is cited in particular.

Although quasicrystalline alloys have in general good mechanical properties, good heat transfer properties and good impact strength and abrasion resistance, they are not, however, all useful as a coating for utensils for cooking food. In this particular application, the quasicrystalline alloy is in contact with the food, this constituting a saline medium, (owing to the addition of sodium chloride to many foods) and possibly an acid medium. It is therefore necessary for the quasicrystalline coating to exhibit good resistance to the corrosion caused by this type of medium. Now, the alloys generally recommended contain copper, which is the cause of a low corrosion resistance.

SUMMARY OF THE INVENTION

The object of the present invention is to provide a quasicrystalline alloy that can be used as a coating for the surface of a cooking utensil in contact with the food to be cooked, which alloy exhibits good mechanical properties, good scratch resistance and good corrosion resistance.

The subjects of the present invention are therefore a coating for the utensil or vessel for cooking food products, and the utensils or vessels with said coating.

DETAILED DESCRIPTION OF THE PREFERRED EMBODIMENTS

A coating according to the present invention consists of an aluminum-based alloy containing more than 80% by weight of one or more quasicrystalline or approximant phases, having the atomic composition $Al_a(Fe_{1-x}X_x)_b(Cr_{1-y}Y_y)_cZ_zJ_j$ in which:

X represents one or more elements isoelectronic with Fe, chosen from Ru and Os;

Y represents one or more elements isoelectronic with Cr, chosen from Mo and W;

Z is an element or a mixture of elements chosen from Ti, Zr, Hf, V, Nb, Ta, Mn, Re, Rh, Ni and Pd;

J represents the inevitable impurities other than Cu;

a+b+c+z=100;

$5 \leqq b \leqq 15$; $10 \leqq c \leqq 29$; $0 \leqq z \leqq 10$;

$xb \leqq 2$;

$yc \leqq 2$; and $j < 1$.

In one particular embodiment, the quasicrystalline alloy has an atomic composition $Al_aFe_bCr_cJ_j$, in which:

a+b+c+j=100; and $5 \leqq b \leqq 15$; $10 \leqq c \leqq 29$; $j < 1$.

A coating according to the present invention may be obtained from an ingot produced beforehand or from ingots of the separate elements taken as targets in a sputtering reactor, or by vapor deposition in which the vapor is produced by the vacuum melting of the bulk material, in all cases from materials containing no copper.

The coating may also be obtained by thermal spraying, for example using an oxy-gas torch, a supersonic torch or a plasma torch, starting from a powder consisting of an alloy having the desired final composition.

The coating may also be obtained by electrodeposition, starting from a powder of quasicrystalline alloy having the composition desired for the final coating.

An alloy intended to be used in bulk form or in powder form for the production of a coating according to the invention may be obtained by conventional metallurgical smelting processes, that is to say those which include a slow cooling phase (i.e. $\Delta T/t$ less than a few hundred degrees per minute). For example, ingots may be obtained by melting the separate metal elements or from prealloys in a lined graphite crucible under a covering of shielding gas (argon, nitrogen), with a covering flux conventionally used in smelting metallurgy, or in a crucible maintained under vacuum. It is also possible to use crucibles made of cooled copper or refractory ceramic, with heating by a high-frequency current. An alloy powder may therefore be prepared by mechanical milling. A powder consisting of spherical particles may furthermore be obtained by atomizing the liquid alloy using an argon jet according to a conventional technique, such a powder being particularly suitable for the preparation of coatings by thermal spraying.

Another subject of the present invention is a utensil or vessel for cooking food products, in which the surface in contact with the food products has a coating according to the present invention.

The present invention is illustrated by the following example, to which it is not, however, limited.

EXAMPLE

Preparation of an AlFeCr Coating by Plasma Spraying

An alloy having the atomic composition $Al_{\sim 70}Fe_{\sim 10}Cr_{\sim 20}$ (that is to say a weight composition $Al_{\sim 54.2}Fe_{\sim 16.0}Cr_{\sim 29.8}$)

was made in powder form by atomization, with a capillary diameter of 4 mm and a nitrogen pressure of 4 bar. The powder was separated into particle size fractions and the powders having a particle size between 20 μm and 90 μm were retained. The actual mass composition of the powder after atomization was $Al_{53.8\pm0.5}Fe_{16.4\pm0.2}Cr_{29.9\pm0.3}$.

Using the powder thus obtained, a coating was deposited on a 316L stainless steel substrate preheated to 250° C., using a plasma torch with a hydrogen flow rate of 0.4 1/min. The coating obtained had a thickness of 200 to 300 μm.

For comparison, coatings were deposited by plasma spraying on 316L stainless steel substrates using the relatively copper-rich composition $Al_{71},Cr_{10.6}Fe_{8.7}Cu_{9.7}$ ("Cristome Al") and from the composition $Al_{69.5}Cu_{0.54}Cr_{20.26}Fe_{9.72}$ (All) in which the copper content was very low.

Corrosion tests (galvanic test, impedance measurements and immersion test) were carried out on specimens consisting of a disk 25 mm in diameter which were treated by metallographic polishing to a felt laden with 3 μm diamond particles.

Galvanometric Tests

The galvanic tests simulated accelerated corrosion. They were carried out on a coating according to the invention of example 1, and, for comparison, on the Al and All alloy coatings using the following operating method. A specimen to be tested, that will serve as working electrode, a platinum plate which will serve as counterelectrode, and a reference electrode were immersed in an aqueous 0.35M NaCl solution at 60° C. An increasing potential was applied between the reference electrode and the specimen. ΔE represents the shift between the floating potential (that is to say the potential that exists intrinsically between the specimen and the reference electrode) and the potential above which the coating starts to dissolve. The results of the galvanic tests carried out are given in the table below.

Impedance Measurements

The impedance measurements were carried out in a cell similar to that used for the galvanic tests. Starting from the equilibrium potential, the sinusoidal potential around the equilibrium potential was applied and the complex impedance was measured as a function of the frequency of the sinusoid. A Nyquist plot was plotted, this being modeled using the equivalent circuits that give interfacial capacitances (connected with the developed area of the specimen) and transfer resistances (connected with the resistance to the flow in solution of the metal ions). The corrosion current $I_c$ was determined through the equation $I_c$=0.02/Rt, Rt being the transfer resistance.

Immersion Tests

For the immersion tests, the specimens were kept for 20 h in an aqueous 0.35M NaCl solution at 60° C. After the specimens were extracted, the surface finish was examined and the immersion solutions were analyzed.

The results of all of the tests are given in the table below.

| Specimen | Example 1 | A1 | A11 |
|---|---|---|---|
| Vickers hardness (100 g load) | 462 | 400 | |
| Corrosion tests | | | |
| $I_C$ | 9 | 20 | 21 |
| ΔE (in V) | 1.36 | 0.40 | |
| Transfer resistance after 2 h (Ω/cm$^2$) | 65300 | 15500 | |
| Immersion test, dissolution measurement | | | |
| Al (mg/l) | 0.50 | 1.10 | |
| Cr (mg/l) | <0.01 | 0.14 | |
| Fe (mg/l) | <0.01 | 0.10 | |
| Cu (mg/l) | | <0.01 | |

These results show that the absence of Cu makes the alloy less sensitive to corrosion in the 0.35M NaCl medium and less sensitive to dissolution in salt water. A very low quantity of Cu, of around 0.54 at %, that is to say an order of magnitude of that of the impurities, is sufficient for the corrosion resistance of an alloy to be significantly reduced. It thus appears to be imperative for the alloys used for the cooking utensil coatings to be completely free of copper.

The invention claimed is:

1. A utensil or vessel for cooking food products, wherein the surface of said utensil or vessel that is in contact with the food products has a coating consisting of an aluminum-based alloy containing more than 80% by weight of one or more quasicrystalline or approximant phases, having the composition $Al_a(Fe_{1-x}X_x)_b(Cr_{1-y}Y_y)_cZ_zJ_j$ in which:

X represents one or more elements isoelectronic with Fe, chosen from Ru and Os;

Y represents one or more elements isoelectronic with Cr, chosen from Mo and W;

Z is an element selected from the group consisting of Ti, Zr, Hf, V, Nb, Ta, Mn, Re, Rh, Ni, Pd mixtures thereof;

J represents the inevitable impurities other than copper;

a+b+c+z=100;

5≦b≦15; 10≦c≦29; 0≦z≦10;

xb≦2;

yc≦2; and j<1, said aluminum-based alloy being free of copper.

2. The utensil or vessel for cooking food products according to claim 1, wherein the the quasicrystalline alloy has an atomic composition $Al_aFe_bCr_cJ_j$, in which:

a+b+c+j=100;

5≦b≦15; 10≦c≦29; and j<1.

* * * * *